US006723389B2

(12) United States Patent
Kobayashi et al.

(10) Patent No.: US 6,723,389 B2
(45) **Date of Patent: *Apr. 20, 2004**

(54) PROCESS FOR PRODUCING COATED CEMENTED CARBIDE EXCELLENT IN PEEL STRENGTH

(75) Inventors: Masaki Kobayashi, Kanagawa (JP); Hiroshi Kitada, Kanagawa (JP)

(73) Assignee: Toshiba Tungaloy Co., Ltd., Kawasaki (JP)

( * ) Notice: Subject to any disclaimer, the term of this patent is extended or adjusted under 35 U.S.C. 154(b) by 27 days.

This patent is subject to a terminal disclaimer.

(21) Appl. No.: 10/022,582

(22) Filed: Dec. 20, 2001

(65) Prior Publication Data

US 2002/0081464 A1 Jun. 27, 2002

Related U.S. Application Data

(62) Division of application No. 09/621,556, filed on Jul. 21, 2000, now abandoned.

(51) Int. Cl.[7] ..... C23C 16/02

(52) U.S. Cl. ..... 427/534; 427/560; 427/307; 427/249.13; 427/255.394; 427/255.29; 427/553; 427/249.4; 427/299

(58) Field of Search ..... 427/534, 560, 427/307, 249.13, 255.29, 255.394

(56) References Cited

U.S. PATENT DOCUMENTS

| | | | | |
|---|---|---|---|---|
| 5,204,167 A | | 4/1993 | Saijo et al. | |
| 5,380,408 A | | 1/1995 | Svensson | |
| 5,591,320 A | | 1/1997 | Rolander | |
| 5,648,119 A | * | 7/1997 | Grab et al. | 427/249.13 |
| 5,660,881 A | * | 8/1997 | Okamura | 427/249.13 |
| 5,709,907 A | * | 1/1998 | Battaglia et al. | 427/126.1 |
| 5,723,253 A | * | 3/1998 | Higashino et al. | 430/166 |
| 6,137,854 A | * | 10/2000 | Ueda et al. | 376/333 |
| 6,589,602 B2 | * | 7/2003 | Kobayashi et al. | 427/404 |

FOREIGN PATENT DOCUMENTS

| | | |
|---|---|---|
| EP | 0 461 756 | 12/1991 |
| EP | 0 787 820 | 8/1997 |
| JP | 63-134660 | 6/1988 |
| JP | 05-123903 | 5/1993 |
| JP | 05-263252 | 10/1993 |
| JP | 06-108253 | 4/1994 |
| JP | 07-243023 | 9/1995 |
| JP | 08-092741 | 4/1996 |
| JP | 08-118105 | 5/1996 |
| JP | 08-187605 | 7/1996 |
| JP | 09-262705 | 10/1997 |
| WO | WO 00/29159 | 1/2002 |

OTHER PUBLICATIONS

Database WPI, Section Ch, Derwent Publications Ltd., London, Great Britian; Glass M11, AN 1999–511216, XP002155137 and JP 11–216602 A (Mitsubishi Materials Corp.), Aug. 10, 1999 *abstract*.

Patent Abstracts of Japan, vol. 1996, No. 1, Jan. 31,1996 & JP 07–243023 A (Mitsubishi Materials Corp.), Sep. 19, 1995, *abstract*, *Cutting Tool Made of Surface Treated Tungsten Carbide–Base Sintered Hard Alloy, Excellent in Breaking Resistance*, Abstract of Suzuki Ikuro.

* cited by examiner

*Primary Examiner*—Bret Chen
(74) *Attorney, Agent, or Firm*—Foley & Lardner

(57) ABSTRACT

A coated cemented carbide excellent in peel strength includes a cemented carbide substrate comprising a hard phase containing tungsten carbide and a binder phase, and a hard film being provided on a surface of the substrate with a single layer or two or more laminated layers, wherein (1) at least part of the surface of the substrate is subjected to machining, and (2)(i) substantially no crack is present in particles of the hard phase existing at an interface of the surface of the substrate subjected to machining and the hard film and/or (2)(ii) peak intensities of crystal surfaces satisfy $$hs(001)_{wc}/hs(101)_{wc} \geqq 1.1 \times hi(001)_{wc}/hi(101)_{wc}$$

wherein $hs(001)_{wc}$ and $hs(101)_{wc}$ each represent a peak intensity of (001) crystal face and that of (101) crystal face at the surface of the substrate subjected to machining processing, respectively, and $hi(001)_{wc}$ and $hi(101)_{wc}$ each represent a peak intensity of (001) crystal face and that of (101) crystal face in the substrate, respectively.

A process for preparing the same is also provided.

16 Claims, No Drawings

PROCESS FOR PRODUCING COATED CEMENTED CARBIDE EXCELLENT IN PEEL STRENGTH

This is a Divisional Application of application Ser. No. 09/621,556, filed Jul. 21, 2000 now abandoned.

BACKGROUND OF THE INVENTION

1. Field of the Invention

This invention relates to a coated cemented carbide to be used as cutting tools represented by an insert, drill and end mill or various kinds of wear-resistant tools and parts, and a process for producing the coated cemented carbide excellent in peel strength in which a hard film is coated.

2. Prior Art

Coated cemented carbides in which a hard film such as TiC, TiCN, TiN, $Al_2O_3$, etc. is coated on the surface of a cemented carbide material by a chemical vapor deposition (CVD) or physical vapor deposition (PVD) method have both of strength and toughness of the substrate and wear resistance of the hard film in combination so that they are frequently used as cutting tools, wear resistant tools or parts, etc. However, if adhesiveness between the substrate and the film is poor, the substrate abruptly wears at the time of use due to peel off of the film, whereby the lifetime is shortened. Thus, in order to ensure adhesiveness, various attempts have been made, e.g., the surface of the substrate is treated for regulation, a film material of a subbing layer is selected, coating conditions of a subbing layer are optimized, and the like.

A substrate of a coated cemented carbide generally comprises a machined surface in which a grinding treatment, a blushing treatment or a blast treatment has been carried out, and a burnt surface in which no machining has been carried out. At the neighbor of the machining surface, a deformed layer (attachment of grinding filings, crack in hard phase particles, interfacial defect between hard phase particles or between a hard phase particle and a binder phase, or deformation of a binder phase) by processing with a thickness of 1 to 5 $\mu$m is remained. On the other hand, at the burnt surface, coarse hard phase particles are remained whereby unevenness is remarkable as compared with the surface subjected to machining.

Also, crystal faces of tungsten carbide existing at the surface particularly at which the machining has been carried out are random, and a ratio of an interface which is coherent with a crystal direction of a subbing layer (mainly TiN, TiC, TiCN, etc.) under a hard film to each other is low. Moreover, in both of the surface subjected to machining and the burnt surface, Co (cobalt) which is a binder phase is not uniformly dispersed in the surface portion so that a uniform diffusion layer is not formed in the hard film at an interface with the hard film.

Accordingly, it is necessary to carry out a surface treatment such as removal of a deformed layer, reduction of unevenness, control of crystal orientation, uniform attachment of Co, etc., to improve peel resistance at an interface between the substrate and the hard film.

As a means for improving peel strength of a coated cemented carbide by removal of the deformed layer and reduction (smoothening) of a surface roughness, there has been proposed a method of adjusting resintering and grinding conditions. The resintering method has been described in, for example, Japanese Provisional Patent Publication No. 123903/1993, and a method of reducing surface roughness has been described in, for example, Japanese Provisional Patent Publication No. 108253/1994.

Moreover, as a prior art references referring to diffusion of Co, W, etc., which are components of substrates into a hard film thereon, there may be mentioned, for example, Japanese Provisional Patent Publications No. 243023/1995, No. 118105/1996, No. 187605/1996, No. 262705/1997, No. 263252/1993, etc.

Also, electro-chemical polishing is described in, for example, Japanese Provisional Patent Publications No. 134660/1988, No. 92741/1996, and Japanese PCT Patent Provisional Publications No. 510877/1998 and No. 510877/1998, etc.

As a method for removing a deformed layer in the prior art, in Japanese Provisional Patent Publication No. 123903/1993, there is disclosed a method for producing a cutting tool member made of a surface-coated WC-base cemented carbide which comprises subjecting a surface of a cemented carbide to grinding processing, resintering the cemented carbide in a high pressure inert gas atmosphere at a temperature of appearing a liquid phase, and subjecting to a chemical vapor deposition (CVD) to form a hard coated layer. According to this method, the deformed layer can be removed by resintering and peeing strength can be improved since uneven surface is formed by grain growth of a cubic system compound. However, unevenness is remained on the surface of the alloy after a hard film is coated thereon so that a material to be processed is likely adhered to the cutting tool. Thus, there are problems that the hard film is rather easily peeled off and a finishing surface precision of the material to be processed is lowered. Moreover, it is difficult to obtain a cemented carbide by controlling a composition (an amount of Co, an amount of a cubic system compound) at the surface to be subjected to resintering, or a specific crystal face of tungsten carbide so that there is a problem that a peeling strength is insufficient and unstable.

On the other hand, as methods for reducing surface roughness and for removing a deformed layer, in Japanese Provisional Patent Publication No. 108253/1994, there is disclosed a coated cemented carbide in which a surface of the cemented carbide is subjected to brush polishing to make an average surface roughness Ra of 0.15 to 0.4 $\mu$m and a hard layer is coated on the surface thereof, at which scratches by grinding are formed to random directions. In the coated cemented carbide disclosed in this reference, whereas adhesion strength of the hard layer is heightened, removal of the deformed layer or making flat the surface of the alloy (removal of projected coarse hard phase particles) is insufficient so that there is a problem that abnormal damage due to peeling of the coating film is likely caused. Moreover, grinding filings containing Co and generated by brush abrasion are attached onto the surface of the cemented carbide but an attached amount of Co is a little and ununiform on the surface so that there is a problem that adhesiveness cannot sufficiently be improved.

With regard to diffusion of components in the substrate of the cemented carbide into a hard film provided on the surface of the cemented carbide, there are some publications. For example, in Japanese Provisional Patent Publications No. 243023/1995, No. 118105/1996, No. 187605/1996 and No. 262705/1998, there are disclosed cutting tools made of surface-coated tungsten carbide-base cemented carbide in which a hard coating layer is formed on the surface of a WC-base cemented carbide base material by the CVD method, wherein the hard coating layer comprises a first layer of TiC or TiN, a second layer of TiCN containing a columnar structure, a third layer of TiC, TiCO, etc., and a fourth layer of $Al_2O_3$ containing a kappa type crystal as a basic layer constitution, and at least W and Co among the components constituting the cemented carbide base material are diffused and contained into the first and second layers, or into the first to the third layers. The coated cemented carbides described in these prior art references are somewhat improved in adhesiveness between the hard coating layer and the cemented carbide due to diffusion of Wand Co into the hard coating layer. However, when a diffusion layer in the hard coating layer is carefully observed at the portion directly above the surface of the base material, the diffusion layer is ununiformly formed markedly. That is, the diffusion layer is extremely thick and a diffused amount is too much on Co which is a binder phase, but substantially no diffusion layer exists on WC or (W,Ti,Ta)C which is a hard phase. For this reason, there is a problem that improvement in adhesiveness is insufficient.

Moreover, as a prior art using electro-chemical polishing technique, in Japanese Provisional Patent Publication No. 134660/1988, there is disclosed a method for producing a surface-coated titanium carbide-base cermet which comprises subjecting a surface of titanium carbide-base cermet to an alkali treatment (including electrolysis), and then, providing a hard film by a chemical vapor deposition (CVD) method. In the electrolysis processing using an alkali (NaOH, KOH) solution disclosed in this reference, improvement in adhesiveness by activating a surface can be expected, but the surface is covered by an electrolyte product such as sodium titanate, etc., so that electro-chemical polishing and smoothening of the surface can hardly be carried out. Moreover, there are problems that cracks (grooves due to stray current corrosion) occur in the hard phase particles due to the electro-chemical polishing using the alkali alone, pores are likely generated at an interface after coating since a porous layer is formed on the surface of the alloy substantially without causing electrolysis of a binder phase, and the like.

Furthermore, in Japanese PCT Provisional Patent Publication No. 510877/1998, there is disclosed a method of forming the point of a blade of cutting tool insert with a predetermined radius according to an electro-chemical polishing technique in which the point of the blade of the tool made of a cemented carbide is rounded by dipping the tool in an electrolyte in which perchloric acid and sulfuric acid are dissolved in an organic solvent and subjecting to electrolysis. Also, in Japanese Provisional Patent Publication No. 92741/1996, there is disclosed a method for treating a surface of a cemented carbide for depositing diamond on which unevenness comprising protections having a trigonal pyramid shape is formed, which comprises burying ceramic particles on the surface of the cemented carbide, and subjecting to an electrolytic etching processing using an inorganic acid as an electrolyte. The electro-chemical polishing techniques described in both of the above references are to preferentially dissolve and remove the binder phase of the cemented carbide by an oxidative strong acid and an electro-chemical reaction. Thus, there are problems that a deformed layer (including fine WC particles attached onto the surface, and cracks in the hard phase particles) obtained by the processing cannot be removed, unevenness at the processed surface is significant, the binder phase at the surface of the alloy is undesirably and preferentially removed, and specific crystal face alone of tungsten carbide particles cannot be increased, so that peeling resistance of the hard film provided on the substrate cannot be improved.

SUMMARY OF THE INVENTION

The present inventors have studied about the method of markedly improving peel strength of a film of a coated cemented carbide for a long period of time, and obtained the following findings. That is, they have found that causes of lowering peel strength are the presence of a deformed layer (including fine WC particles attached onto the surface, and cracks in the hard phase particles) subjected to processing which exists on the surface of the cemented carbide base material; coarse hard particles existing at a burnt surface to which no processing is carried out; and too excessive or too little, or ununiform dispersion of a binder phase on the both surfaces. They have also found that if hard phase fine particles remained at an interface between the cemented carbide substrate and a hard film, and cracks in the hard phase particles can be removed, peel strength can be particularly and markedly improved so that practical performance can be remarkably improved. Moreover, they have found that peel strength can be improved by being oriented a crystal face of tungsten carbide particles, forming a diffusion layer at an interface between the hard film and the cemented carbide, or the like. For the purpose of removing or smoothening the deformed layer subjected to processing, or orientation of the crystal face, they have found that it is optimum to subject the cemented carbide to electro-chemical polishing in an aqueous solution containing at least one compound selected from the group consisting of a nitrite, a sulfite, a phosphite or a carbonate of a metal of Group 1 of the Periodic Table as an essential component. Moreover, they have found that a coated cemented carbide in which a hard film is coated on the surface of a substrate which has been subjected to electro-chemical processing is markedly excellent in peel strength. Furthermore, they have found that an iron-group metal is uniformly coated on the surface of the cemented carbide which has been subjected to electro-chemical polishing, the resulting cemented carbide is more improved in peel resistance whereby the present invention has been accomplished.

The coated cemented carbide excellent in peel strength of the present invention is a coated cemented carbide which comprises a cemented carbide substrate comprising a hard phase containing tungsten carbide and a binder phase, and a hard film being provided on a surface of the substrate with a single layer or two or more laminated layers, wherein (1) at least part of the surface of the substrate is subjected to machining, and (2) (i) substantially no crack is present in particles of said hard phase existing at an interface of the surface of the substrate subjected to machining and the hard film and/or (2) (ii) peak intensities of crystal surfaces satisfy $$hs(001)_{wc}/hs(101)_{wc} \geqq 1.1 \times hi(001)_{wc}/hi(101)_{wc}$$

wherein $hs(001)_{wc}$ and $hs(101)_{wc}$ each represent peak intensities of (001) crystal face and (101) crystal face at the surface of the substrate subjected to machining, respectively, and $hi(001)_{wc}$ and $hi(101)_{wc}$ each represent peak intensities of (001) crystal face and (101) crystal face in the substrate, respectively.

Also, a process for producing the coated cemented carbide of the present invention comprises the steps of:

(A) subjecting to at least surface-pretreatments of
  (1) machining processing of at least part of a surface of a cemented carbide substrate comprising a hard phase containing tungsten carbide, and a binder phase, and
  (2) (a) effecting an electro-chemical polishing treatment on the surface of the substrate or (2)(b) effecting the electro-chemical polishing treatment and a coating treatment onto at least part of the surface of the substrate with at least one of an iron-group metal element and a compound thereof to form a uniform film, and then, (B) providing at least one hard film on the surface of the resulting substrate.

DESCRIPTION OF THE PREFERRED EMBODIMENTS

In the following, the present invention is explained in detail.

The coated cemented carbide excellent in peel strength of the present invention comprises (1) a cemented carbide substrate which comprises, as particles of a hard phase, tungsten carbide, or tungsten carbide and at least one cubic system compound selected from the group consisting of a carbide, a nitride or a carbonitride of a metal element of Group 4 (Ti, Zr, Hf), 5 (V, Nb, Ta) or 6 (Cr, Mo, W) of the Periodic Table and a mutual solid solution of the above-mentioned compounds and, as a binder phase, an iron-group metal (Fe, Co, Ni); and (2) a hard film comprising at least one compound selected from the group consisting of a carbide, anitride or an oxide of a metal element of Group 4, 5 or 6 of the Periodic Table, aluminum or silicon, and a mutual solid solution of the above-mentioned at least two compounds, which film is formed with a single layer or laminated layers of two or more layers on a surface of the substrate at least part of which is subjected to machining, and substantially no crack is present in the particles of said hard phase existing at an interface of the surface of the substrate subjected to machining and the hard film.

The substrate of the coated cemented carbide of the present invention may specifically comprise a WC-Co series or a WC-(Ni—Cr) series alloy in which hard phase particles consist of tungsten carbide, or a WC-TaC-Co series, a WC-(W,Ti,Ta)C—Co series or a WC-(W,Ti,Ta,Nb) (C,N)-Co series alloy in which hard phase particles comprises tungsten carbide and a cubic system compound(s), and an amount of the binder phase thereof is 3 to 30% by volume.

The hard film to be formed on the surface of the coated cemented carbide of the present invention may preferably a single-layered film such as TiC, TiCN, TiN, (Ti,Zr)N, (Ti, Al)N, CrN, etc., or a laminated layer comprising, in the order from the surface of the substrate, TiC/TiN/TiCN/TiN, TiN/TiC/$Al_2O_3$/TiN, TiN/(Ti,Al)N/TiN, TiN/$Si_3N_4$, etc., each prepared by a chemical vapor deposition (CVD) method or a physical vapor deposition (PVD) method and having a total thickness of 1 to 20 $\mu$m.

In the coated cemented carbide of the present invention, crack in the particles of the hard phase in the substrate at the interface of the above hard film and the surface of the substrate subjected to machining referred to in the present specification means fine cracks propagated from the surface of the particles such as WC, (W,Ti,Ta)C, etc., or penetrated into the inside thereof which can be observed by a scanning type electron microscope at the cross section of the coated cemented carbide. Here, substantially no crack means that cracks can hardly be observed by a scanning type electron microscope with a high magnification degree (10,000 to 50,000-fold), more specifically, a ratio of hard phase particles having crack with a length of 0.1 $\mu$m or more is 5% or less based on the total hard phase particles.

Incidentally, the surface of the substrate subjected to machining means that at least part of the surface has been removed from the surface portion with a depth of several $\mu$m or more according to the process such as the whetstone grinding, brush grinding, lap processing, blast processing, ultrasonic wave processing, electrolysis cutting processing, etc. According to these machining processings, cracks sometimes occur in the hard phase particles immediately below the surface of the substrate.

In the coated cemented carbide of the present invention, it is preferred that the particles of the hard phase are constituted by particles having a diameter (absolute value) of substantially more than 0.2 $\mu$m at the whole interface including at the surface of the substrate not subjected to machining since peel strength becomes more excellent. Hard phase particles having a size of 0.2 $\mu$m or less are grinding filings remained on the surface of the cemented carbide substrate having a usual particle size (0.5 to 5 $\mu$m) after grinding and hard phase fine particles exist at the interface at least partially in a ranging state. Here, the particles of the hard phase comprising substantially more than 0.2 $\mu$m mean that substantially no fine particle can be observed by a scanning type electron microscope with a high magnification degree (10,000 to 50,000-fold). More specifically, a number of the fine particles having a particle size of 0.2 $\mu$m or less is 1 or less within an area around an interfacial length of 10 $\mu$m.

In tungsten carbides at the surface of the substrate subjected to mechanical processing and at inside of the alloy according to the coated cemented carbide of the present invention, with regard to peak intensities of crystal surfaces of a WC (001) face and a WC (101) face, when peak intensities of (001) crystal face and (101) crystal face at the surface of the substrate subjected to machining are each represented by $hs(001)_{wc}$ and $hs(101)_{wc}$, respectively, and peak intensities of (001) crystal face and (101) crystal face in the substrate are each represented by $hi(001)_{wc}$ and $hi(101)_{wc}$, respectively, if they satisfy the following equation:

$$hs(001)_{wc}/hs(101)_{wc} \geqq 1.1 \times hi(101)_{wc}/hi(101)_{wc}$$

crystals of tungsten carbide particles at the surface of the substrate and crystals of particles at the subbing layer of the coated hard film are bound with a good coherent relationship, whereby peel strength can be further improved. If the coefficient is less than 1.1, there is a little fitting plane between the $(001)_{wc}$ at the surface of the substrate and the $(111)_{TiX}$ (wherein TiX means a titanium compound such as TiN, TiC, TICN, etc., and $(111)_{TiX}$ shows (111) plane of TiX) at a subbing layer under the hard film so that improved effects in adhesiveness are low. The coefficient is preferably a value exceeding 1.2.

More specifically, when a subbing layer is present and comprises a titanium compound (it is represented by "TiX" which includes TiN, TiC, TICN, etc.), there is a good coherent relationship between $(111)_{TiX}$ of these crystals and $(001)_{wc}$ of the tungsten carbide crystals at the surface of the substrate that misfit therebetween is minimum and they can effect epitaxial growth. For increase the fitting plane, the tungsten carbide crystal at the surface of the substrate may be oriented to $(001)_{wc}$. However, at the surface of the substrate of the cemented carbide at which the surface is removed by the mechanical processing, an amount of $(001)_{wc}$ is a little as in the inside thereof. Thus, to increase the $(001)_{wc}$ at the surface subjected to the mechanical processing, crystal surfaces other than $(001)_{wc}$ are preferentially removed.

In the coated cemented carbide excellent in peel strength according to the present invention, at least part of the surface of the cemented carbide is a burnt surface in which no grinding processing is carried out. The hard phase particles at the interface between the hard film and the burnt surface of the cemented carbide, which had not been subjected to mechanical processing, satisfies the formula: ds≦di wherein ds represents an average particle size of the particles at the burnt surface and di represents an average particle size of the particles at inside of the alloy.

More specifically, convex portions of the coarse and squarish hard phase particles which exist in the burnt surface with a large amount are removed by electro-chemical polishing, whereby frictional resistance at use is reduced and peel resistance can be improved.

The shape of the hard phase particles at the burnt surface of the coated cemented carbide of the present invention may include, for example, a coarse and squarish triangular prism shape, a triangular plate shape, a rectangular parallelepiped shape or a polyhedral shape particle in the case of a WC hard phase, and a semi-polyhedral shape or a semi-sphere shape particle in which an upper portion (convex portions at the outermost surface) of a coarse sphere or polyhedral shape particle is removed in the case of a (W,Ti,Ta)C hard phase. By removing the convex portion of the coarse hard phase particle, the particle becomes finer and the average particle size of the particles at the burnt surface becomes the same as or less than the average particle size of the particles at inside of the alloy. Here, the shape and the average particle size of the hard phase particles can be observed and measured its burnt surface structure and sectional structure of the alloy by using a scanning type electron microscope, etc.

Also, in the cross section of the coated cemented carbide, the hard phase particles are preferably projected outward with a height of less than 2.0 $\mu$m.

In the coated cemented carbide of the present invention, a diffusion layer in which an iron-group metal element and tungsten are diffused therein is present in the hard film directly above the hard phase particles at the interface between the hard film and the cemented carbide irrespective of the machined surface or the burnt surface of the substrate. More specifically, according to analysis at a minute portion of the hard film-sectional structure of the coated cemented carbide, both of Co and W are contained in the hard film directly above the hard phase particles of the substrate such as WC, (W,Ti,Ta)C, etc. (i.e., in the diffusion layer), each in an amount of 3 atomic % or more with the minimum value.

Incidentally, in the coated cemented carbides of the prior art, whereas diffusions of Co and W are remarkable in the hard film directly above at binder phase particles of the substrate such as Co, etc., substantially no Co or W is inspected directly above at hard phase particles. Thus, it is ununiform as a diffusion layer. When the hard film at around the interface of the prior art is analyzed, amounts of Co and W are markedly fluctuated from 0 to 10 atomic %.

In the coated cemented carbide of the present invention, an iron-group metal (such as Fe, Co, Ni and alloys based on at least one of these metals) layer with an average thickness of 0.5 $\mu$m or less is preferably formed at an interface between the hard phase particles of the substrate and a subbing layer of the hard film or the above-mentioned diffusion layer, since adhesiveness between the hard phase particles and the hard film is more improved and propagation of cracks from the hard film can be prevented whereby defects can be sometimes prevented.

In the coated cemented carbide of the present invention, the cemented carbide substrate and the hard film at around the interface are preferably at least one selected from the group consisting of anitride, a carbide or a carbonitride of titanium, and a solid solution of these materials and tungsten carbide, since the subbing layer is oriented to a (111) face at the interface with the tungsten carbide particles at the surface of the substrate and an area of a fitting plane having the relationship of $(111)_{TiX}//(001)_{wc}$ is increased whereby adhesiveness is improved.

A process for preparing the coated cemented carbide of the present invention comprises, in the coated cemented carbide excellent in peel strength comprising (1) a cemented carbide substrate which comprises, as particles of a hard phase, tungsten carbide, or tungsten carbide and at least one of cubic system compounds selected from the group consisting of a carbide, a nitride or a carbonitride of a metal element of Group 4, 5 or 6 of the Periodic Table and a mutual solid solution of the above-mentioned compounds and, as a binder phase, an iron-group metal; and (2) a hard film comprising at least one compound selected from the group consisting of a carbide, a nitride or an oxide of a metal element of Group 4, 5 or 6 of the Periodic Table, aluminum or silicon, and a mutual solid solution of the above-mentioned compounds, which is formed with a single layer or laminated layers of two or more layers on a surface of the substrate, subjecting at least part of a surface of the cemented carbide substrate to machining; subjecting the surface to an electro-chemical polishing treatment, or to the electro-chemical polishing treatment using an alkaline aqueous solution containing at least one compound selected from the group consisting of a sulfite, a phosphite or a carbonate of a metal of Group 1 of the Periodic Table and a coating treatment of at least one of an iron-group metal element and a compound thereof on at least part of the surface of the substrate to form a uniform film; and then, covering at least one hard film on the surface of the substrate.

The surface of the substrate in the preparation process of the coated cemented carbide according to the present invention comprises a burnt surface which has not subjected to machining and/or a surface in which a processed surface obtained by removing a burnt surface by machining being copresent. More specifically, such a substrate may include an exchangeable insert for milling in which the whole surfaces are subjected to grinding processing, an exchangeable insert in which a burnt surface is remained at a breaker surface or a relief face, or a drill in which a burnt surface is remained at a groove surface or a two-step margin portion, or the like. Also, a method of machining is not limited and may include many methods, for example, whetstone grinding, brushing grinding, lap processing, blast processing, ultrasonic wave processing, etc.

An electrolytic solution to be used in the preparation process of the coated cemented carbide according to the present invention is an aqueous solution containing at least one compound selected from the group consisting of a nitrite, a sulfite, a phosphite and a carbonate of a metal of Group 1 of the Periodic Table as an essential component. More specifically, such a compound may be mentioned, for example, $NaNo_2$, $KNO_2$, $Na_2SO_3$, $NaHPO_3$, $Na_2CO_3$, etc. as an essential component. The aqueous solution may further include an aqueous solution of a salt such as sodium tartrate, potassium nitrate, sodium phosphate, sodium sulfate, borax, Rochelle salt (potassium sodium tartrate), sodium tungstate, potassium ferricyanide, etc., or an organic solvent solution of the above compounds, and the organic solvent may include an amine, an alcohol, etc. The specific electrolysis conditions may include, for example, a concentration of the aqueous solution: 50 to 300 g/l, a voltage: 1 to 5 V, a current: 0.02 to 0.5 A/cm$^2$, an electrolysis time: 0.2 to 5 min.

An electrolyte to be used in the preparation process of the coated cemented carbide according to the present invention is preferably an aqueous solution containing a nitrite of sodium and/or potassium as a main component(s) of the electrolyte since an amount of a crystal surface $(001)_{wc}$ is increased and an electro-chemical polishing surface slightly enriched in a binder phase can be obtained. Also, it is preferred to use an aqueous solution containing a carbonate of sodium and/or potassium and a ferricyanide as main components of the electrolyte since a cubic series compound can be preferentially removed and a surface enriched in a binder phase can be obtained. Moreover, it is preferred to use an aqueous solution containing a nitrite or a carbonate of sodium and/or potassium and a chloride of the same as main components of the electrolyte since an amount of the binder phase on the surface can be controlled by changing their ratio in the electrolytic solution.

In the preparation process of the coated cemented carbide according to the present invention, a coating method of an iron-group metal element which may be applied after the electro-chemical polishing is preferably chemical coating methods such as an electric plating, an electroless plating, a vacuum deposition (PVD), a vapor phase reaction plating (CVD), a colloid coating, a solution coating, etc.; and mechanical coating methods such as a blast processing and a shot processing using a shot material mainly comprising an iron-group metal, or a mixture of the shot material and an abrasive or a grinding material, etc. This is because, when the above-mentioned methods are employed, a deformed layer produced by the processing can hardly be formed on the surface of the substrate. Also, it is possible to coat the iron-group metal element onto a minute region such as on the hard phase particles uniformly and finely, whereby adhesiveness can be sufficiently improved by the formation of a uniform diffusion layer. In particular, it is preferred to employ an electric plating using an aqueous solution containing an iron-group metal salt as a main component of an electrolyte or using a waste of an electrolytic solution in the electroplating processing as a coating method, since the processing steps of electrolysis and coating can be continuously and easily carried out.

In the coated cemented carbide excellent in peel strength according to the present invention, cracks in hard phase particles or fine hard phase particles are not present on or at the surface the cemented carbide substrate subjected to machining, an amount of $(001)_{wc}$ of tungsten carbide crystal is increased on the surface of the substrate, and convex portions of the hard phase particles at the burnt surface which has not subjected to machining are removed to provide a smooth surface so that peel strength is improved thereby. When a diffusion layer in which an iron-group metal and W are diffused and contained in the hard film directly above the hard phase particles of the surface of the substrate is formed, the layer has a function of further improving peel strength of the film. In the preparation process thereof, by subjecting the surface of the cemented carbide substrate to electro-chemical polishing by an electrolytic solution, preferably by an alkaline electrolytic solution, cracks in hard phase particles or fine hard phase particles formed at the machining surface can be removed, an amount of $(001)_{wc}$ of tungsten carbide crystal can be increased, the burnt surface can be smoothened and the composition of the surface of the substrate can be controlled. Moreover, the coating treatment of an iron-group metal occasionally carried out has a function of forming a uniform diffusion layer.

EXAMPLES

In the following, the present invention will be explained in more detail by referring to Examples but the present invention is not limited by these Examples.

Example 1

As a substrate of a coated cemented carbide, an insert raw material comprising a composition (%by weight) of 86.0WC-1.5TiC-0.5TiN-4.0TaC-8.0Co which is CNMA120408 according to ISO standard was used. The upper and the bottom surfaces were subjected to grinding processing by using a diamond whetstone having an abrasive grain size of 53 $\mu$m or less, and the point portion of the blade was subjected to horning processing with a diameter of 0.04 mm using a brush made of Nylon containing silicon carbide abrasive grains having an abrasive grain size of 43 $\mu$m or Less. Then, the respective materials were each subjected to electrolysis (or electro-chemical polishing) treatment by using an electrolytic solution, a voltage, a current value and a treatment time shown in Table 1 at room temperature. In some cases, after subjecting to electro-chemical polishing treatment, an electroplating treatment (using an electrolytic solution, a voltage, a current value and a treatment time also shown in Table 1) or an electroless plating treatment was carried out.

On the other hand, as comparative samples, an insert subjecting to no electrolytic treatment, an insert in which lap polishing is further carried out only at the point portion of the blade material using a diamond paste having a particle size of 1.0 $\mu$m or less, an insert in which the whole surfaces thereof are subjected to a wet blast treatment by using alumina powder having an abrasive grain size of 19 $\mu$um or less, and an insert which is subjected to resintering at 1573° K. for 60 minutes were separately prepared.

TABLE 1

| Sample No. | Contents of treatment | Electrolytic solution (% by weight) | Voltage (V) | Current ($A/cm^2$) | Treatment time (min) |
|---|---|---|---|---|---|
| Product of the present invention | | | | | |
| 1 | Electropolishing | 10% $NaNO_2$ | 4.0 | 0.10 | 0.5 |
| 2 | Electropolishing | 10% $NaNO_2$ | 4.0 | 0.25 | 0.5 |
| 3 | Electropolishing + | 10% $NaNO_2$ | 4.0 | 0.25 | 0.5 |
| | Electroplating | 10% $CoSO_4$ | 2.0 | 0.50 | 0.5 |
| 4 | Electropolishing | 10% $Na_2CO_3$ | 4.0 | 0.10 | 0.5 |
| 5 | Electropolishing | 10% $Na_2SO_3$ + 5% $NaHPO_3$ | 4.0 | 0.10 | 0.5 |
| 6 | Electropolishing | 10% $Na_2CO_3$ + 10% NaCl | 3.0 | 0.10 | 0.5 |
| 7 | Electropolishing + | 10% $Na_2CO_3$ + 10% NaCl | 4.0 | 0.25 | 0.5 |
| | Electroplating | 10% $NiSO_4$ | 1.5 | 0.30 | 1.0 |
| 8 | Electropolishing | 10% $K_2CO_3$ + 10% $K_4$ [$Fe(CN)_6$] | 4.0 | 0.10 | 0.5 |

TABLE 1-continued

| Sample No. | Contents of treatment | Electrolytic solution (% by weight) | Voltage (V) | Current ($A/cm^2$) | Treatment time (min) |
|---|---|---|---|---|---|
| 9 | Electropolishing + | 10% $K_2CO_3$ + 10% $K_4$ [$Fe(CN)_6$] | 4.0 | 0.10 | 0.5 |
| | Electroless plating | Commercially available electroless Co plating solution | — | — | 0.5 |
| 10 | Electropolishing + | 10% $NaNO_2$ + 5% $KNO_3$ | 4.0 | 0.25 | 0.5 |
| | Electroplating | 10% $CoSO_4$ | 2.0 | 0.50 | 1.0 |
| Comparative product | | | | | |
| 1 | Electropolishing | 10% NaOH | 4.0 | 0.10 | 0.5 |
| 2 | No treatment | | | | |
| 3 | Lap treatment | | | | |
| 4 | Wet blast treatment | | | | |
| 5 | Re-sintering or calcination | | | | |

After washing these inserts subjected to the respective treatments with an ultrasonic wave in acetone, they were each formed coating films having a thickness of 11.0 μm in total comprising, from the side of the substrate, 1.0 μm of TiN, 8.0 μm of prismatic TiCN, 1.5 μm of $Al_2O_3$ and 0.5 μm of TiN by using a CVD coating apparatus to obtain the products of the present invention 1 to 10 and comparative products 1 to 5. Each one of the thus obtained tool inserts was cut, and after the cut surface was subjected to lap processing with a diamond paste having a particle size of 0.3 μm or less, and then, an interface between the cemented carbide substrate and the hard film was observed by using an electric field emission type scanning electron microscope with a high magnification. The portions observed were three portions of the point of the blade portion, the grinding processing portion of the upper and the bottom surfaces, and the burnt surface of the outer peripheral portion. In Table 2 shown below, observed results of cracks in the hard phase particles and fine particles having 0.2 μm or less of the hard phase are shown. Also, measured results of average particle sizes of the hard phases (WC) at the surface of the cemented carbide substrate and at the inside of the same are shown in Table 2.

TABLE 2

| | Point of blade portion | | | | Upper and bottom surface (polishing) | | | | Outer peripheral surface (burnt surface) | | | |
|---|---|---|---|---|---|---|---|---|---|---|---|---|
| | | Fine particles | WC particle size (μm) | | | Fine particles | WC particle size (μm) | | | Fine particles | WC particle size (μm) | |
| Sample No. | Crack | | Surface | Inside | Crack | | Surface | Inside | Crack | | Surface | Inside |
| Product of the present invention | | | | | | | | | | | | |
| 1 | None | None | 0.45 | 0.65 | None | None | 0.44 | 0.66 | None | None | 0.47 | 0.65 |
| 2 | None | None | 0.42 | 0.66 | None | None | 0.45 | 0.65 | None | None | 0.48 | 0.65 |
| 3 | None | None | 0.55 | 0.65 | None | None | 0.51 | 0.64 | None | None | 0.54 | 0.66 |
| 4 | None | None | 0.50 | 0.63 | None | None | 0.55 | 0.65 | None | None | 0.56 | 0.64 |
| 5 | None | None | 0.51 | 0.65 | None | None | 0.54 | 0.63 | None | None | 0.51 | 0.68 |
| 6 | None | None | 0.46 | 0.64 | None | None | 0.45 | 0.65 | None | None | 0.49 | 0.65 |
| 7 | None | None | 0.42 | 0.64 | None | None | 0.47 | 0.62 | None | None | 0.44 | 0.65 |
| 8 | None | None | 0.51 | 0.65 | None | None | 0.50 | 0.65 | None | None | 0.50 | 0.65 |
| 9 | None | None | 0.44 | 0.65 | None | None | 0.47 | 0.64 | None | None | 0.45 | 0.66 |
| 10 | None | None | 0.43 | 0.66 | None | None | 0.45 | 0.65 | None | None | 0.47 | 0.61 |
| Comparative product | | | | | | | | | | | | |
| 1 | Little portion | None | 0.61 | 0.64 | Little portion | Small amount | 0.58 | 0.67 | None | None | 0.70 | 0.65 |
| 2 | Many portions | Large amount | 0.43 | 0.65 | Many portions | Large amount | 0.41 | 0.65 | None | None | 1.13 | 0.63 |
| 3 | Little portion | Small amount | 0.48 | 0.65 | Many portions | Large amount | 0.46 | 0.65 | None | None | 1.21 | 0.65 |
| 4 | Many portions | Large amount | 0.42 | 0.62 | Many portions | Large amount | 0.51 | 0.64 | Many portions | Large amount | 0.53 | 0.65 |
| 5 | None | None | 1.32 | 0.64 | None | None | 1.25 | 0.61 | None | None | 1.37 | 0.67 |

Next, intensity peak ratios: $(001)_{wc}/(101)_{wc}$ of WC peaks at the surface and the inside of the respective tool inserts thus obtained were obtained by effecting X-ray diffraction analysis using a Cu target with regard to the upper and the lower surfaces, and the sectional surface (inside of the alloy)of the tool inserts. The results are shown in Table 3. Incidentally, X-ray diffraction analyses at the upper and the lower surfaces were measured through the hard film, so that peaks of the hard film components are accompanied to WC peaks but the WC peak intensity ratio of the surface of the cemented carbide substrate does not change.

Moreover, the portion near to the point of the blade portion (brush processed portion) of the tool insert was cut to make a thin plate, and the plate was subjected to lap polishing and electro-chemical polishing to prepare a sample for measuring with a transmission electron microscope. Then, amounts of Co (including Ni) and W in the film directly above the WC particle at the interface were measured. Each sample was measured at ten portions and the results are also shown in Table 3 as a range of measured values. Also, a thickness of a Co (including Ni) layer directly above the WC particle was also measured.

By using the respective five tool inserts, an outer peripheral discontinuous turning test was carried out under the conditions of:

Workpiece: carbon steel (0.45% C) with four grooves,

Cutting speed: 150 m/min,

Depth of cut: 2.0 mm,

Feed: 0.30 mm/rev., and under wet conditions.

Defect at the point of the blade until the times of impacts reaches to 10,000 times by the discontinuous cutting, or as for the sample in which it reached to 10,000 times, peeing of the film (chipping, etc.) at that time was observed. The results are also shown in Table 3.

TABLE 3

| Sample No. | $(001)_{WC}/(101)_{WC}$ Surface | Inside | 1.2 × inside | Co amount (at %) | W amount (at %) | Co layer thickness (μm) | Degree of damage at point of blade (Defect:Film peeling:Normal) |
|---|---|---|---|---|---|---|---|
| Product of the present invention | | | | | | | |
| 1 | 0.55 | 0.34 | 0.41 | 0 to 2 | 0 to 4 | 0 | 0:1:4 |
| 2 | 0.51 | 0.33 | 0.39 | 0 to 3 | 0 to 1 | 0 | 0:2:3 |
| 3 | 0.47 | 0.34 | 0.40 | 9 to 15 | 10 to 17 | 0.1 | 0:0:5 |
| 4 | 0.56 | 0.34 | 0.41 | 0 to 4 | 0 to 3 | 0 | 0:1:4 |
| 5 | 0.42 | 0.33 | 0.40 | 0 to 2 | 0 to 2 | 0 | 0:3:2 |
| 6 | 0.47 | 0.34 | 0.41 | 0 to 2 | 0 to 3 | 0 | 0:0:5 |
| 7 | 0.50 | 0.34 | 0.41 | 11 to 12 | 10 to 15 | 0.2 | 0:1:4 |
| 8 | 0.46 | 0.33 | 0.39 | 0 to 5 | 0 to 4 | 0 | 0:2:3 |
| 9 | 0.50 | 0.32 | 0.38 | 11 to 15 | 10 to 14 | 0.1 | 0:0:5 |
| 10 | 0.44 | 0.35 | 0.42 | 12 to 16 | 9 to 14 | 0.4 | 0:1:4 |
| Comparative product | | | | | | | |
| 1 | 0.38 | 0.33 | 0.39 | 0 to 3 | 0 to 2 | 0 | 1:2:2 |
| 2 | 0.39 | 0.34 | 0.41 | 4 to 8 | 3 to 8 | 0 | 3:2:0 |
| 3 | 0.37 | 0.33 | 0.40 | 3 to 8 | 4 to 7 | 0 | 1:3:1 |
| 4 | 0.36 | 0.34 | 0.41 | 3 to 9 | 2 to 6 | 0 | 0:4:1 |
| 5 | 0.47 | 0.33 | 0.39 | 0 to 1 | 0 to 1 | 0 | 2:3:0 |

Example 2

By using an insert raw material of SNGN 120408 which is an ISO standard comprising 88.0WC-2.0TaC-10.0Co (weight %) as a substrate of a coated cemented carbide, the upper and the lower surfaces and the outer peripheral surface were subjected to grinding processing with a diamond whetstone having an abrasive grain size of 53 μm or less, and the point portion of the blade was subjected to horning processing with −25° ×0.10 mm using a diamond whetstone having an abrasive grain size of 38 μm or less. Then, under the same conditions as in the products 1 and 3 of the present invention shown in Table 1 of Example 1, surface treatments were each carried out. These samples and an insert which is not subjected to electrolysis treatment were washed in acetone by using an ultrasonic wave. These samples were each formed coating films having a thickness of 5.0 μm in total comprising, from the side of the substrate, 0.5 μm of TiN, 3.5 μm of prismatic TiCN, 0.5 μm of $Al_2O_3$ and 0.5 μm of TiN by using a CVD coating apparatus to obtain the products of the present invention 11 and 12, and comparative product 6.

The thus prepared tool inserts were observed by a scanning type electron microscope in the same manner as in Example 1. As a result, cracks in the hard phase particles, and hard phase particles with a size of 0.2 μm or less cannot be observed in the products 11 and 12 of the present invention, whereas almost all the hard phase particles had cracks and a number of fine hard phase particles could be admitted at an interface of the comparative product 6. By using the respective tool inserts, milling was carried out under the conditions of:

Workpiece: Cr—Mo alloy steel (shape of processing surface: 50W×200),

Cutting speed: 135 m/min,

Depth of cut: 2.0 mm,

Feed: 0.36 mm/rev., and under dry conditions.

Defect at the point of the tool at that time of processing 40 passes was observed. As a result, a number of therma cracks generated at a rake face was each three in the products 11 and 12 of the present invention whereas it was five in the comparative product 6. Also, in the comparative product 6, there were admitted a V-groove shaped were at the peripheral of the thermal cracks, a minute chipping at the point of the blade portion, and peeling of film at a crater portion of the rake face.

Example 3

Electrolytic treatment was applied to a commercially available solid end mill (Φ: 6 mm, two-sheets blades) made of a cemented carbide under the conditions of the product 1 of the present invention shown in Table 1 of Example 1, and then washed in acetone by ultrasonic wave with a sample in which no electrolytic treatment was carried out. Thereafter, they were mounted on an arc ion plating apparatus to deposit about 3.0 μm of a (Ti, Al)N film whereby surface-coated hard end mills of the present product 13 and the comparative product 7 were obtained.

By using these samples, a groove processing test was carried out under the conditions of:

Workpiece: Pre-harden steel (HRC=40),

Cutting speed: 30 m/min,

Depth of cut: 10 mm,

Feed rate: 64 mm,

Feed per tooth: 0.02 mm/blade, and under wet conditions, and a relief face wear width of the cutting blade at the time of a cutting length of 50 m was each measured. As a result, the product 13 of the present invention was 0.06 mm whereas the comparative product 7 was 0.11 mm.

Example 4

A punch for punching treatment was prepared by using a commercially available cemented carbide raw material (corresponding to V30 of JIS) for wear-resistant tool with a size of Φ 10 mm×60 mm and subjecting it to a rough grinding and finish grinding treatment with diamond whetstones having an abrasive grain size of 104 μm or less and that of 19 μm or less, respectively, and then, the sample was subjected to surface treatment under the conditions of the product 3 of the present invention shown in Table 1 of Example 1.

The thus obtained material and a punch to which no surface treatment had been carried out were each washed in acetone with an ultrasonic wave, and deposited a film having a thickness of 4.0 μm in total comprising, from the side of the substrate, 0.5 μm of TiN and 3.5 μm of TiCN by a CVD coating apparatus to obtain surface-coated hard punch of the product 14 of the present invention and that of the comparative product 8. By using these punches, a zinc plate with a thickness of 0.6 mm was punched and a number of shots at which a failure product is generated by flash was measured. As a result, the product 14 of the present invention was about 900,000 shots whereas the comparative product 8 was about 350,000 shots.

In the coated cemented carbide prepared by the chemical vapor deposition (CVD) method or the physical vapor deposition (PVD) method of the present invention, adhesiveness with a hard film can be markedly improved as compared with the pre-treatment of the coating step of the conventional processing. Thus, when the coated cemented carbide of the present invention is used as an insert for cutting tools, drills or wear-resistant tools, damages accompanied by peeling of the hard film can be reduced so that stable lifetime can be obtained. Also, according to the process of the present invention, convex portions of the hard phase particles at a burnt surface become smooth and a diffusion layer is formed in the hard film directly above the hard layer, whereby peel strength of the hard film can be more improved.

What we claimed is:

1. A process for producing a coated cemented carbide which comprises at least the steps of (A) subjecting to at least surface-pretreatments of (1) machining processing of at least part of a surface of a cemented carbide substrate comprising a hard phase containing tungsten carbide, and a binder phase, and (2)(a) effecting an electro-chemical polishing treatment on the surface of the substrate or (2)(b) effecting the electro-chemical polishing treatment and a coating treatment onto at least part of the surface of the substrate with at least one of iron, cobalt and nickel and a compound thereof to form a uniform film, and then, (B) providing at least one hard film, which comprises a single layer or two or more laminated layers, comprising at least one material selected from a carbide, a nitride and an oxide of an element selected from elements of the Groups 4, 5 and 6 of the Periodic Table, aluminum and silicon and a mutual solid solution thereof, on the surface of the resulting substrate.

2. The process according to claim 1, wherein the machining processing is at least one selected from the group consisting of a whetstone grinding, brush grinding, lap processing, blast processing and ultrasonic wave processing.

3. The process according to claim 1, wherein the electro-chemical polishing treatment in the pretreatment is carried out by using an electrolytic solution containing at least one compound selected from the group consisting of a hydroxide, a nitrite, a sulfite, a phosphite or a carbonate of a metal of Group 1 of the Periodic Table.

4. The process according to claim 3, wherein the electrolytic solution comprises at least one compound selected from the group consisting of a nitrite of sodium and/or potassium, a hydroxide and a ferricyanide of the same, and a hydroxide and a chloride of the same.

5. The process according to claim 1, wherein the coating treatment in the pretreatment is at least one chemical coating method selected from the group consisting of electroplating, electroless plating, vacuum deposition, physical vapor deposition (PVD), chemical vapor deposition (CVD), colloid coating and solution coating; or at least one mechanical coating method selected from the group consisting of blast processing using a shot material mainly comprising an iron, cobalt and nickel or a mixture of the shot material and at least one of a grinding material and a polishing material, and a shot processing.

6. The process according to claim 5, wherein the coating treatment in the pretreatment is an electroplating using a solution containing iron, cobalt and nickel as main component or a waste solution of the electrolytic solution in the electro-chemical polishing treatment.

7. The process according to claim 1, wherein the process comprises the step (2)(a) of effecting the electro-chemical polishing treatment on the surface of the substrate.

8. The process according to claim 1, wherein the process comprises the step (2)(b) of effecting the electro-chemical polishing treatment and the coating treatment onto at least part of the surface of the substrate with at least one of iron, cobalt and nickel and a compound thereof to form the uniform film.

9. The process according to claim 8, wherein the at least one of iron, cobalt and nickel comprises iron or a compound thereof.

10. The process according to claim 8, wherein the at least one of iron, cobalt and nickel comprises cobalt or a compound thereof.

11. The process according to claim 8, wherein the at least one of iron, cobalt and nickel comprises nickel or a compound thereof.

12. The process according to claim 1, wherein the hard film comprises a TiN layer.

13. The process according to claim 1, wherein the hard film comprises a TiCN layer.

14. The process according to claim 1, wherein the hard film comprises an $Al_2O_3$ layer.

15. The process according to claim 1, wherein the hard film comprises a first TiN layer, a TiCN layer, an $Al_2O_3$ layer and a second TiN layer.

16. The process according to claim 1, wherein a deformed layer on the surface of the substrate is removed by the electro-chemical polishing treatment.

* * * * *